United States Patent [19]

Morita

[11] 4,455,719

[45] Jun. 26, 1984

[54] STOPPER USING A MAGNET

[76] Inventor: Tamao Morita, 41-1, 6-chome, Arakawa, Arakawa-ku, Tokyo, Japan

[21] Appl. No.: 492,159

[22] Filed: May 11, 1983

Related U.S. Application Data

[63] Continuation of Ser. No. 222,984, Jan. 7, 1981, abandoned.

[51] Int. Cl.[3] ..... A44B 17/00; A44C 13/10

[52] U.S. Cl. ..... 24/303

[58] Field of Search ..... 24/201 B, 303; 63/29 M; 292/251.5

[56] References Cited

U.S. PATENT DOCUMENTS

| | | | |
|---|---|---|---|
| 496,408 | 5/1893 | Hall | 24/94 |
| 1,829,361 | 10/1931 | Lane | 24/94 |
| 2,970,857 | 2/1961 | Squire | 292/251.5 |
| 3,009,225 | 11/1961 | Budreck | 24/201 B |
| 3,034,025 | 5/1962 | Budreck et al. | 24/201 B |
| 3,041,697 | 7/1962 | Budreck | 24/201 |
| 3,086,268 | 4/1963 | Chaffin, Jr. | 24/201 B |
| 3,111,737 | 11/1963 | Heil | 24/201 B |
| 3,141,216 | 7/1964 | Brett | 24/201 B |
| 3,324,521 | 6/1967 | Humiston | 24/201 B |
| 3,372,443 | 3/1968 | Daddona, Jr. | 24/201 B |
| 4,021,891 | 5/1977 | Morita | 24/201 B |

FOREIGN PATENT DOCUMENTS

| | | | |
|---|---|---|---|
| 1268582 | 6/1961 | France | 24/201 B |
| 281897 | 1/1931 | Italy | 24/113 MP |
| 250979 | 9/1947 | Switzerland | 24/113 MP |

*Primary Examiner*—Paul J. Hirsch

*Attorney, Agent, or Firm*—Holman & Stern

[57] ABSTRACT

A magnetic fastener comprising a first fastening element, including a permanent magnet having oppositely facing pole faces of opposite polarity and at least one peripheral edge, the magnet having a hole extending between the first pole face and the second pole face, a first ferromagnetic plate in contact with the first pole face, a first fastening means secured to the first ferromagnetic plate, a first ferromagnetic rod disposed within and coaxial with the hole and secured to the first ferromagnetic plate, a magnetic shielding ferromagnetic plate in support with the second pole face and having an opening passing therethrough, which opening is coaxial with the hole, and a nonmagnetic housing surrounding the at least one peripheral edge of the permanent magnet, the non-magnetic housing securing the first ferromagnetic plate and the magnetic shielding ferromagnetic plate to the permanent magnet by means of inwardly radial extending edge portions, which edge portion of said housing adjacent the magnetic shielding ferromagnetic plate defines an aperture coaxial with the hole, and a second fastening element detachably engaging the first fastening element, including a second ferromagnetic plate, a second fastening means secured to the second ferromagnetic plate, and a second ferromagnetic rod secured to the second ferromagnetic plate, so that when the first and second fastening elements are engaged, the first ferromagnetic rod projects into said hole and contacts the second ferromagnetic rod and the second ferromagnetic plate contacts the magnetic shielding ferromagnetic plate or the edge portion of the housing adjacent thereto.

8 Claims, 30 Drawing Figures

STOPPER USING A MAGNET

This is a continuation of application Ser. No. 222,984, filed Jan. 7, 1981 now abandoned.

BACKGROUND OF THE INVENTION

This application relates to co-pending application Ser. No. 477,838 filed Mar. 25, 1983, which is a continuation of Ser. No. 309,762 filed Oct. 8, 1981 (now abandoned), which was a continuation of Ser. No. 89,134, filed Oct. 29, 1979 (now abandoned), and design application Ser. No. 258,039, filed Apr. 27, 1981.

This invention relates to a stopper or fastener using a magnet, and more specifically, to a fastener in which lines of magnetic force in a magnet are prevented from being leaked from the stopper, thereby preventing trouble which results from the leaked lines of magnetic force. This is particularly useful in preventing destruction of a magnetic recording portion of a magnetic tape and the like. In the present invention the lines of magnetic force peculiar to the magnet are gathered into an engaging hole edge in the magnet to form an optimum magnetic field for magnetic adhesion.

The stopper of this invention is used as engaging means generally for bags, boxes, bands, chains and the like, and is expected to be used extensively as a fastener or buckle for hand-bags, bags, small article containers, rucksacks, belts for trousers, shoulder bands, necklesses, pendants, shoe bands or the like.

This invention further provides an arrangement wherein in actual use, iron sand is deposited and drawn toward the peripheral side portion of a magnet hole to secure a magnetic adhesion surface of the other stopper with respect to the magnet.

The more detailed operation and effects of this invention will be further apparent from the following specific explanation of the embodiments of the stopper.

BRIEF DESCRIPTION OF THE DRAWINGS

In the accompanying drawings.

DESCRIPTION OF THE PREFERRED EMBODIMENTS

In the following explanation, various embodiments of this invention will be described in detail by way of respective embodiments, and the operation and effects resulting from these embodiments also will be described in detail.

Figure 1:
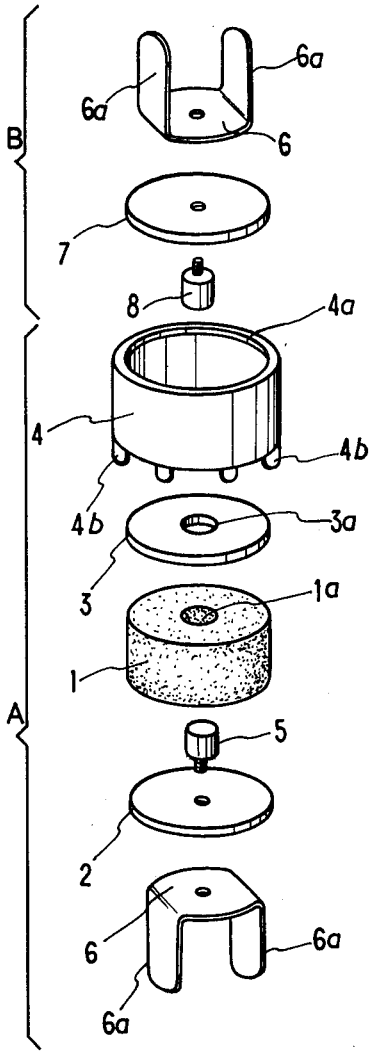
FIG. 1 is an exploded perspective view of a part of the product showing one embodiment of a stopper in accordance with the present invention.
Figure 4:
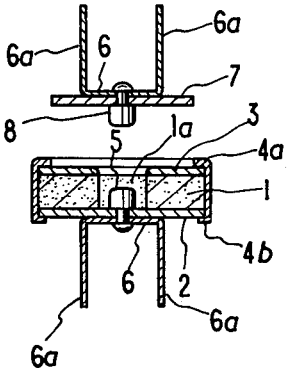
FIGS. 4 through 30 are, respectively, sectional views showing various embodiments.

Reference is made to FIGS. 1 and 4 which show a typical embodiment of the present invention in which a cylindrical permanent magnet 1 having a hole 1*a* in a central portion thereof is prepared, a ferromagnetic plate 2 is attached to one magnetic hole surface in the permanent magnet 1 and a magnetic shielding ferromagnetic plate 3 attached to the other magnetic hole surface except the magnetic hole 1*a*, and a case 4 formed of a non-magnetic material which at least partially covers the plates 2 and 3 and secures same to the magnet 1.

It should be noted that the plate 3 is not necessarily composed of a single sheet but may be composed of a plurality of sheets, and the surface of the plate 3 is sometimes formed with a suitable hole. In any case, the magnetic shield effect can be achieved.

This case 4 has a function to secure the plates 2 and 3 to the magnet 1, a function to protect the outer periphery of the magnet, and a function to prevent a magnetic tape x or the like from direct contact with the magnet 1 and the plate 3. In the embodiment shown in FIG. 4, there is disclosed a cylindrical case 4 in which an inner peripheral edge flange 4*a* is placed in engagement with the surface of the plate 3, and engaging members or prongs 4*b*—4*b* protruding from the open edge of the case 4, are bent over the surface of the plate 2 so as to integrally embrace the magnet 1 and plates 2 and 3.

A ferromagnetic rod 5 disposed upright on the surface of the plate 2 is connected to a mounting washer 6 having bent legs 6*a* and 6*a* by inserting a small diameter rod portion projecting from the rod 5 through the plate 2, and is stood upright, considerably magnetically spaced apart with respect to the inner surface of the hole 1*a*.

Thus constructed one fastening element is indicated by bracket A while the other fastening element indicated by bracket B, and a ferromagnetic plate 7 magnetically adhered to the plate 3 on the magnetic pole surface in the magnet 1 and the mounting washer 6 having bent prongs or legs 6*a*, 6*a* are integrally connected by means of a small diameter rod portion on the ferromagnetic rod 8. The plate 7 is of such shape and dimensions so that it is housed, when the fastener is fully assembled, within the edge flange 4*a* in the case 4. The rod 8 is of sufficient length so that it comes into intimate contact with the head end of the rod 5 when the plate 7 is in intimate contact with the plate 3, and peripheral edges of head ends of the rods 5 and 8 are formed with a radius or rounded surface to reduce the actual contact surface between the rods 5 and 8

The rod 8 has a diameter smaller than that of the hole 1*a* so that the rod does not make contact with the inner peripheral wall of the hole 1*a* similar to the arrangement noted above for rod 5. Such a state of non-contact is maintained by engagement of the plate 7 with the edge flange 4*a*.

The result of the above-mentioned construction gives rise to functions as follows.

Figure 2:
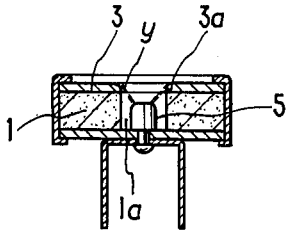
FIG. 2 is a sectional view for the purpose of explanation showing the gathered state of lines of magnetic force and the deposited state of iron sand along the lines of magnetic force.
Figure 3:
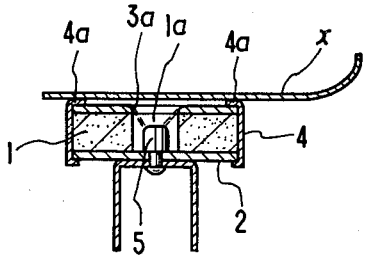
FIG. 3 is a sectional view for the purpose of explanation showing the state with a magnetic tape placed in contact.

(1) The presence of the plate 3 causes all the lines of magnetic force of the magnet 1 to pass through the plate 3 without depicting a circle on the upper surface, and a magnetic path is formed at a position where resistance is minimum as shown in FIG. 2. As a consequence, the lines of magnetic force basically pass between the inner hole edge 3*a* of the plate 3 and the peripheral edge of the top end of the rod 5 to completely prevent external leakage of magnetism.

(2) Further, the lines of magnetic force are produced between the inner hole edge 3*a* of the plate 3 and the peripheral edge of the top end rod 5 whereby even if iron sand enters hole 1*a*, the iron sand y, as shown in FIG. 2, is magnetically adhered along the thus produced lines of magnetic force and the top end surface of the rod 5 is not covered with iron sand y and the rod 8 may be placed in intimate contact with rod 5.

(3) In addition, with this gathering of the lines of magnetic force, the lines of magnetic force peculiar to the magnet 1 are gathered at the end edge of the plate 3 to minimize leakage thus achieving increased effects of magnetic adhesion.

(4) This effect of magnetic adhesion is further insured by moving the rods 5 and 8 from the inner wall surface of the magnetic hole 1*a* by a distance not affected by the lines of magnetic force to form a complete magnetic closed circuit in the rods 5 and 8.

(5) This effect of magnetic adhesion is still further increased by providing the outer periphery at the extremities of the rods 5 and 8 with a radius to reduce the area of contact between the surfaces of the rods 5 and 8, that is, the flux distribution passing through the contact ends is increased in density, a condition most suitable for magnetic adhesion.

(6) Even if the magnetic tape x or the like comes into direct contact with the fastening element A, the magnetic recording portion is positively protected from the destruction because of a small circle depicted by the lines of magnetic force leaked outside and covering the magnet 1 with the case 4, and even in the magnetic pole surface, the presence of the edge flange 4*a* basically avoids contact of the magnetic tape x with the magnetic pole surface.

Figure 5:
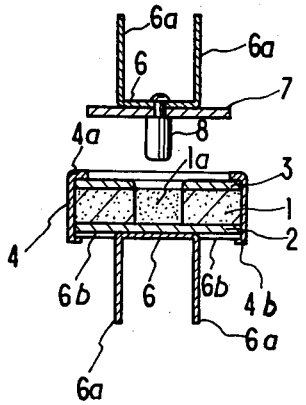

Next, in the embodiment shown in FIG. 5, the rod 5 is omitted and instead, the rod 8 is placed in direct contact with the plate 2, in which case the similar effect to that of FIG. 4 may be achieved. However, since the rod 5 is omitted, it is possible to caulk the washer 6 and the peripheral edge 6*b* of the washer 6 is extended so that the washer may be integrally fixed to the magnet 1 together with the plate 2 by the engaging member 4*b* in the case 4.

Figure 6:
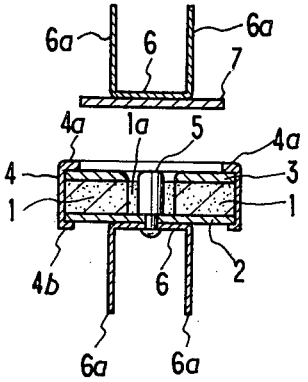

The embodiment shown in FIG. 6 is opposite to that of shown in FIG. 5, that is, the rod 8 is omitted and instead, the rod 5 is in registration with the upper surface of the plate 3. In this case, the plate 7 is magnetically adhered to the upper end of the rod while engaging the end flange 4*a* of the case 4. In this construction, the peripheral edge of the upper end of the rod 5 is positioned in proximity to the open edge of the plate 3 to further promote the effect of magnetic adhesion as described in the above paragraph (3).

Figure 7:
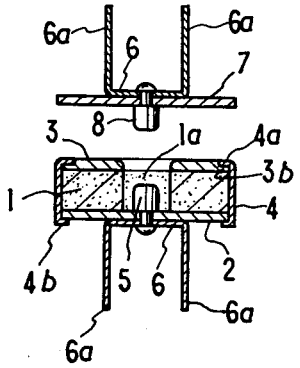

FIG. 7 shows an embodiment wherein a recessed-stepped edge 3*b* provided in the peripheral edge of the plate 3, and edge flange 4*a* of the case 4 is placed in engagement with the recessed-stepped edge 3*b* to register the upper surface of the edge flange 4*a* with the upper surface of the plate 3 whereby the whole magnetic pole surface may be covered with the plate 7.

Figure 8:
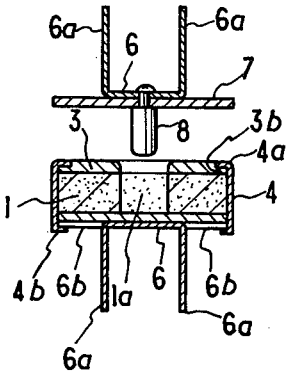

The embodiment shown in FIG. 8 comprises a combination of the mounting construction of the case in the embodiment of FIG. 7 and the construction of the embodiment shown in FIG. 5.

Figure 9:
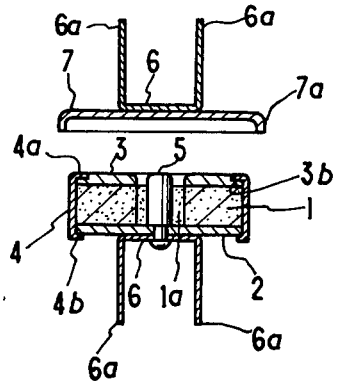

The embodiment shown in FIG. 9 comprises a combination of the mounting construction of the case 4 in the embodiment of FIG. 7 and the construction of the embodiment shown in FIG. 6, in which the peripheral edge of the plate 7 is bent to form an engaging edge flange 7*a*.

Figure 10:
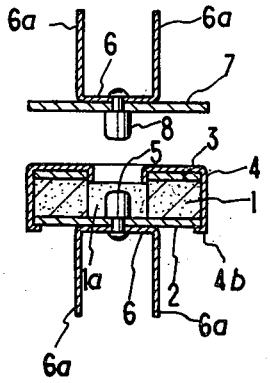
Figure 11:
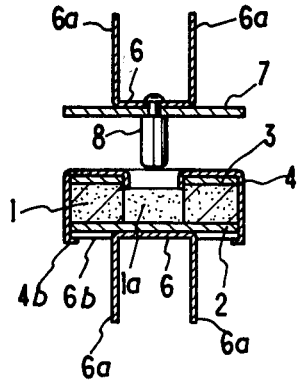
Figure 12:
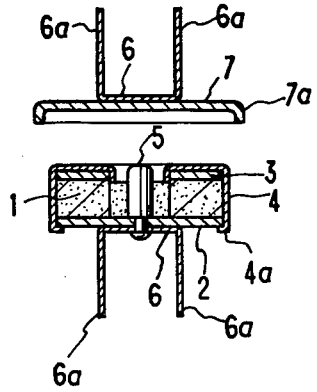

FIGS. 10 to 12 show embodiments in which the plate 3 is totally covered with the case 4 to completely prevent direct contact of the magnetic tape x or the like with the plate 3.

Figure 13:
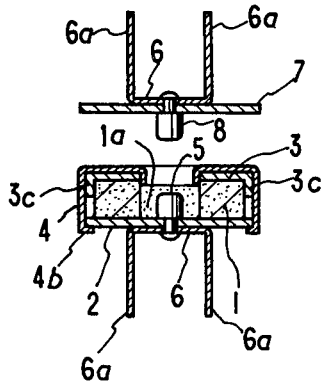
Figure 14:
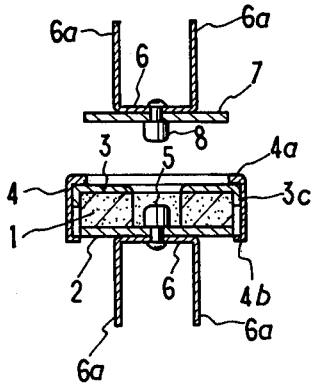
Figure 15:
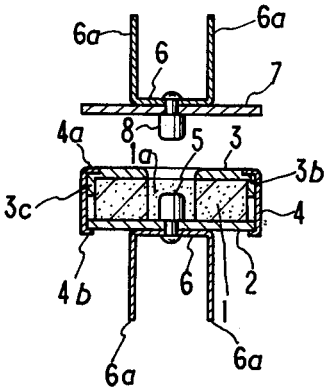

FIGS. 13 to 15 show embodiments in which the outer peripheral edge of the plate 3 is extended downwardly sideway to form a edge flange 3*c*, and a circle depicted by the lines of magnetic force produced between the end flange 3*c* and the plate 2 are reduced to minimize trouble resulting from the magnetic force.

Figure 16:
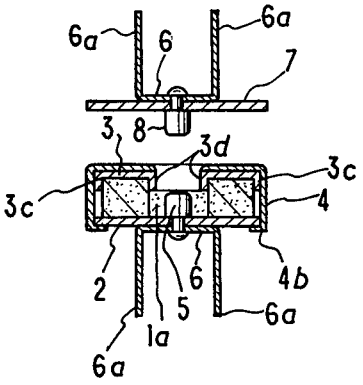
Figure 17:
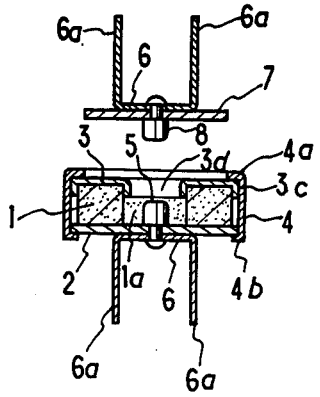
Figure 18:
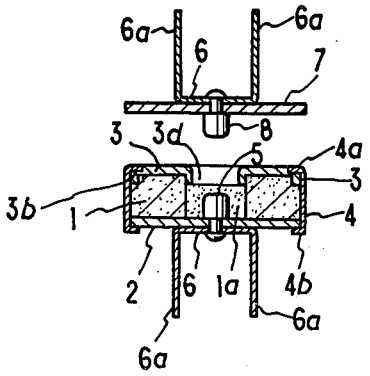

FIGS. 16 to 18 show embodiments wherein an inner hole edge in the plate 3 comprises an edge flange 3*d* bent into the hole 1*a* to produce magnetic flux between the edge flange 3*d* and the outer peripheral edge of the upper end of the rod 5, thus assuring providing the prevention of magnetic leakage and marked increase in effect of magnetic adhesion.

Figure 19:
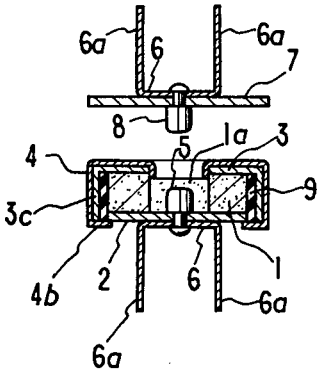
Figure 20:
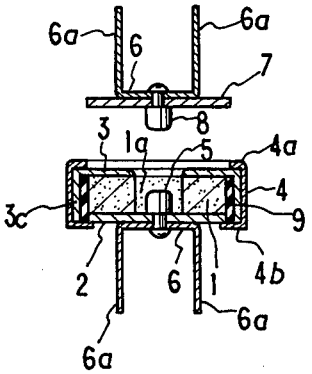
Figure 21:
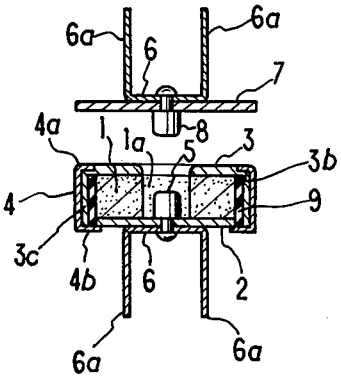

FIGS. 19 to 21 show embodiments wherein an edge flange 3*c* of the plate 3 is provided to completely cover the peripheral side of magnet 1 and the side of the plate 2, thus completely preventing magnetic leakage. It should be noted that in terms of manufacture, in maintaining a clearance between the magnet 1 and the plate 3, a cylindrical non-magnetic ring 9 formed of plastic or the like is fitted on the outer peripheral surface of the magnet 1.

Figure 22:
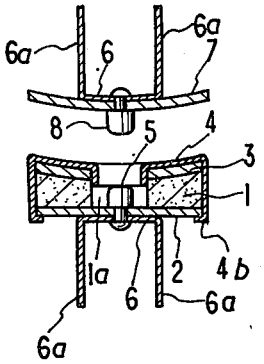
Figure 23:
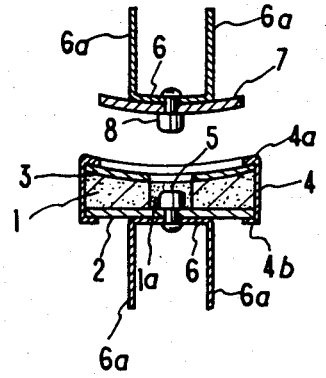
Figure 24:
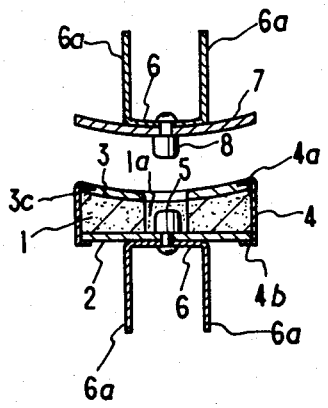
Figure 25:
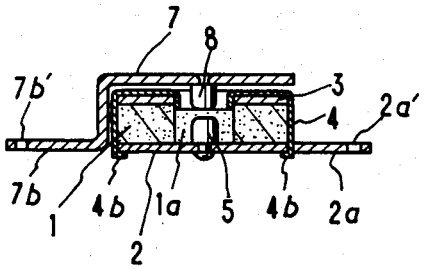
Figure 26:
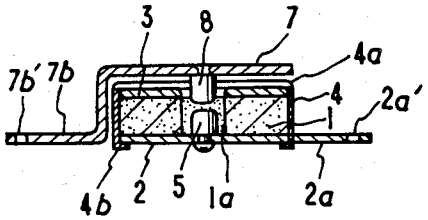
Figure 27:
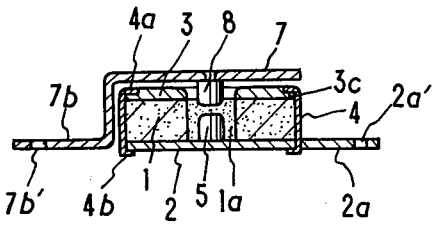

FIGS. 22 to 24 show embodiments wherein the plate 7 and the plate 3 in contact with the plate 7 or the end of the case are in the form of a convex spherical surface or a concave spherical surface to assist the insertion of the rod into the hole 1*a*.

Embodiments shown in FIGS. 25 to 30 disclose a retainer means for bands, chains or the like in which the plate 2 is extended sideways to form an engaging portion 2*a* and the plate 7 is bent to form an engaging portion 7*b*. In this case, the engaging portion 2*a* and 7*b* are positioned on a straight line for the purpose of minimizing this engagement between both fastening elements A and B against the pulling force. In FIGS. 26 to 29, both sides of the case 4 are stood upright to form an edge flange 4*a* thus positively preventing lateral displacement of the plate 7. In the drawings, reference numerals 2*a*′ and 7*b*′ designate mounting holes for chains, bands and the like.

Figure 28:
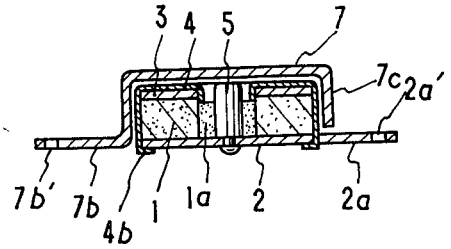
Figure 29:
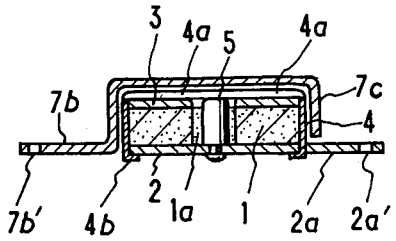
Figure 30:
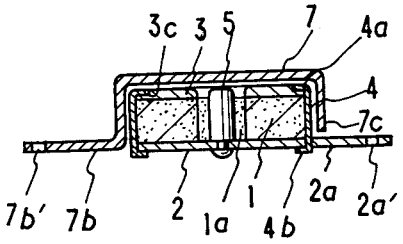

In the embodiments shown in FIGS. 28 to 30, the side edge of the plate 7 is extended downwardly to form an engaging portion 7*c* against the pulling force in the mounting direction of the plate 7, namely in a direction of the plate 7*b*.

And, the magnetic tape expressed as magnetic tape x in our specification represents not only the standard magnetic recording tapes but also the magnetic recording part used in cash card issued in a bank, credit card, identity card, membership identity card, tickets for the train and admission, etc.

What is claimed is:

1. A magnetic fastener comprising:

(a) a first fastening element, including a permanent magnet having oppositely facing pole faces of opposite polarity and at least one peripheral edge, said magnet having a hole extending between the first pole face and the second pole face;

a first ferromagnetic plate in contact on one face thereof with said first pole face;

a first fastening washer secured to said first ferromagnetic plate on the other face thereof;

a first ferromagnetic rod disposed within and coaxial with said hole and secured to said one face of said first ferromagnetic plate, said first rod having a smaller diameter than said hole to provide an annular space between said rod and hole;

a rod-like extension projecting from said rod through said first plate and attached at the other end to said washer to secure said rod, plate and washer together;

a magnetic shielding ferromagnetic plate in contact with said second pole face and having an opening passing therethrough, which opening is coaxial with said hole; and a nonmagnetic housing having an edge portion surrounding the at least one peripheral edge of said permanent magnet, inwardly directed extensions on said edge portion for securing said first ferromagnetic plate and said magnetic shielding ferromagnetic plate to said permanent magnet, the edge portion of said housing adjacent said magnetic shielding ferromagnetic plate defining an aperture coaxial with said hole; and (b) a second fastening element detachably engageable with said first fastening element, including a second ferromagnetic plate;

a second fastening washer secured to said second ferromagnetic plate; and a second ferromagnetic rod having a diameter substantially equal to the diameter of said first rod secured to said second ferromagnetic plate, a rod-like extension projecting from said second rod through said second plate and attached at the other end to said second washer to secure said second rod, plate and washer together, so that when the first and second fastening elements are engaged, said second ferromagnetic rod projects into said hole and contacts said first ferromagnetic rod and said second ferromagnetic plate contacts said magnetic shielding ferromagnetic plate.

2. A magnetic fastener comprising:

(a) a first fastening element, including a permanent magnet having oppositely facing pole faces of opposite polarity and at least one peripheral edge, said magnet having a hole extending between the first pole face and the second pole face;

a first ferromagnetic plate in contact on one face thereof with said first pole face;

a first fastening washer secured to said first ferromagnetic plate on the other face thereof;

a ferromagnetic rod disposed within and coaxial with said hole and secured to said one face of said first ferromagnetic plate, said rod having a diameter smaller than the diameter of said hole to provide an annular space between said rod and said hole;

a rod-like extension projecting from said rod through said first plate and attached at the other end to said washer to secure said rod, plate and washer together;

a magnetic shielding ferromagnetic plate in contact with said second pole face and having an opening passing therethrough, which opening is coaxial with said hole; and a nonmagnetic housing having an edge portion surrounding the at least one peripheral edge of said permanent magnet, inwardly directed extensions on said edge portion securing said first ferromagnetic plate and said magnetic shielding ferromagnetic plate to said permanent magnet, the edge portion of said housing adjacent said magnetic shielding ferromagnetic plate defining an aperture coaxial with said hole; and (b) a second fastening element detachably engageable with said first fastening element; including a second ferromagnetic plate, and a second fastening washer secured to said second ferromagnetic plate, so that when the first and second fastening elements are engaged, said ferromagnetic rod contacts said second ferromagnetic plate and said second ferromagnetic plate contacts said magnetic shielding ferromagnetic plate.

3. A magnetic fastener comprising:

(a) a first fastening element, including a permanent magnet having oppositely facing pole faces of opposite polarity and at least one peripheral edge, said magnet having a pole extending between the first pole face and the second pole face;

a first ferromagnetic plate in contact on one face thereof with said first pole face;

a first fastening washer secured to said ferromagnetic plate on the other face thereof;

a magnetic shielding ferromagnetic plate in contact with said second pole face and having an opening passing therethrough, which opening is coaxial with said hole; and a nonmagnetic housing having an edge portion surrounding the at least one peripheral edge of said permanent magnet, inwardly directed extensions on said edge portion securing said first ferromagnetic plate and said magnetic shielding ferromagnetic plate to said permanent magnet, the edge portion of said housing adjacent said magnetic shielding ferromagnetic plate defining an aperture coaxial with said hole, and (b) a second fastening element detachably engageable with said first fastening element; including a second ferromagnetic plate;

a second fastening washer secured to said second ferromagnetic plate; and a ferromagnetic rod secured to said second ferromagnetic plate, a rod-like extension projecting from said second rod through said second plate and attached at the other end to said second washer to secure said second rod, plate and washer together, so that when the first and second fastening elements are engaged, said ferromagnetic rod projects into said hole and contacts said first ferromagnetic plate, said rod having a smaller diameter then said hole to provide an annular space between said rod and said hole when said fastening elements are engaged.

4. The magnetic fastener according to claim 1, 2 or 3, wherein the outer edge of said magnetic shielding ferromagnetic plate forms a collar extending contiguous to the at least one peripheral edge and toward said first ferromagnetic plate.

5. The magnetic fastener according to claim 1, 2 or 3, wherein the inner edge of said magnetic shielding ferromagnetic plate adjacent said opening forms a rim extending within the hole contiguous to the inner surface of the permanent magnet defining the hole.

6. The magnetic fastener according to claim 3, wherein said edge portion of said housing adjacent said magnetic shielding ferromagnetic plate overlaps the entire outer surface of said magnetic shielding ferromagnetic plate.

7. The magnetic fastener according to claim 1, 2 or 3, wherein said edge portion of said housing adjacent said magnetic shielding ferromagnetic plate engages an outer peripheral recessed - stepped edge of said magnetic shielding ferromagnetic plate such that the outer surface of said inwardly radial extending edge portion and the outer contacting surface of said magnetic shielding ferromagnetic plate substantially lie in one plane.

8. The magnetic fastener according to claim 3, wherein said edge portion of said housing adjacent said magnetic shielding ferromagnetic plate overlaps the entire outer surface of said magnetic shielding ferromagnetic plate and a centrally located portion thereof forms a rim extending within the hole of the permanent magnet contiguous to the inner surface defining the hole.

* * * * *